US005671465A

United States Patent [19]

Kimura et al.

[11] Patent Number: 5,671,465

[45] Date of Patent: Sep. 23, 1997

[54] IMAGE FORMING APPARATUS HAVING A REVOLVER TYPE DEVELOPING DEVICE

[75] Inventors: Noriyuki Kimura, Kawasaki; Minoru Suzuki, Yokohama; Kouji Sakamoto, Tokyo; Kouichi Noguchi, Machida; Tsuyoshi Deki, Koshigaya; Hiroyuki Matsushiro, Yokohama; Eiichi Sasaki, Sagamihara; Takatsugu Fujishiro; Chiyako Kobayashi, both of Tokyo, all of Japan

[73] Assignee: Ricoh Company, Ltd., Tokyo, Japan

[21] Appl. No.: 567,739

[22] Filed: Dec. 5, 1995

Related U.S. Application Data

[63] Continuation of Ser. No. 224,291, Apr. 7, 1994, abandoned.

[30] Foreign Application Priority Data

Apr. 8, 1993 [JP] Japan ..... 5-082044

[51] Int. Cl.[6] ..... G03G 15/04; G03G 15/01

[52] U.S. Cl. ..... 399/119; 399/227

[58] Field of Search ..... 355/200, 210, 355/245, 260, 326 R, 327; 399/111, 112, 119, 120, 223, 224, 226, 227

[56] References Cited

U.S. PATENT DOCUMENTS

| | | | |
|---|---|---|---|
| 4,406,535 | 9/1983 | Sakamoto et al. | 355/251 |
| 4,561,381 | 12/1985 | Kaneko et al. | 118/652 |
| 4,640,129 | 2/1987 | Miyakawa et al. | 73/866 |
| 4,697,915 | 10/1987 | Hayashi et al. | 355/327 |
| 4,743,938 | 5/1988 | Ohno | 355/327 |
| 4,755,847 | 7/1988 | Matsushiro et al. | 355/259 |
| 4,782,360 | 11/1988 | Iwamoto et al. | 355/326 R |
| 4,835,565 | 5/1989 | Nagatsuna et al. | 355/259 |
| 4,896,625 | 1/1990 | Sakamoto et al. | 118/657 |
| 4,899,689 | 2/1990 | Takeda et al. | 118/651 |
| 4,922,301 | 5/1990 | Katoh et al. | 355/326 R X |
| 5,040,031 | 8/1991 | Hayashi et al. | 355/326 R |
| 5,115,275 | 5/1992 | Suzuki | 355/245 |
| 5,162,859 | 11/1992 | Hirono et al. | 355/327 X |
| 5,198,866 | 3/1993 | Kimura et al. | 355/326 R |
| 5,223,668 | 6/1993 | Takaya et al. | 118/651 |
| 5,258,819 | 11/1993 | Kimura et al. | 355/326 R |
| 5,289,243 | 2/1994 | Sakamoto | 355/260 |
| 5,325,151 | 6/1994 | Kimura et al. | 355/200 |

*Primary Examiner*—Sandra L. Brase

*Attorney, Agent, or Firm*—Oblon, Spivak, McClelland, Maier & Neustadt, P.C.

[57] ABSTRACT

In an image forming apparatus, a developing device is disposed adjacent to a belt-like photosensitive member. A rotary type developing device has a hollow cylindrical casing rotatable around a shaft having a central portion for rotation. The developing device includes a casing which is rotated in a predetermined direction, and four partitions which divide the casing to make four developing units which extend radially outward from the shaft. A toner storing section or hopper is provided on one side of the developing device, i.e., on a front side of the image forming apparatus, and a toner cartridge is detachable from a top of the hopper, and the toner cartridge is exchanged when an end signal of the toner is detected by a sensor in the casing. The toner hopper is filled by new toner from the toner cartridge, and the toner is carried by conveyor members, which control an amount of the toner in the casing, and a supply roller supplies the toner to a developing roller. Therefore, the device supplies a required amount of toner to a toner supply roller and a developing roller at all times. This provides an image forming apparatus with a great freedom of layout which needs a minimum sectional space relative to a photoconductive element and which, therefore, has a miniature configuration. Also, if amounts of transport of first and second conveyor members are adequately selected, a uniform developer distribution in a longitudinal direction without resorting to a complicated control is insured.

23 Claims, 4 Drawing Sheets

IMAGE FORMING APPARATUS HAVING A REVOLVER TYPE DEVELOPING DEVICE

This application is a continuation of application Ser. No. 08/224,291, filed on Apr. 7, 1994, now abandoned.

BACKGROUND OF THE INVENTION

1. Field of the Invention

The present invention relates to an image forming apparatus having a revolver type device which accommodates a plurality of developing units therein, such as a printer, copying machine, facsimile machine, etc.

2. Description of the Related Art

A full color copier belongs to a family of image forming apparatus electrostatically forming latent images on a photoconductive element or image carrier, by an exposing device to color-dissolved light images, developing each latent image by a toner complementary in color to the associated light image, and transferring the resulting toner images to single sheets one above the other. Also available in the imaging art is a multi-color image forming apparatus which forms latent images to be developed in different colors one by one on an image carrier, develops them by developers of different colors, and transfers the resulting toner images to a single sheet. While these types of image forming apparatus need a plurality of developing units, the developing units undesirably scale up the apparatus when constructed independently of each other and arranged around the image carrier.

A revolver type or rotary type developing device is an implementation developed to solve the above problem. This type of developing device has a rotatable hollow cylindrical casing which faces an image carrier and which accommodates a plurality of developing units at predetermined positions therein. The casing is rotated to sequentially locate the developing unit at a developing position. As a result, latent images formed on the latent image carrier are each developed by a toner of a particular color.

In the above mentioned revolver type or rotary type developing device, it is necessary to supply toner for developing the latent images on a latent image carrier from a toner container which is provided in the developing device or out of the developing device, to a developing roller. For example, Japanese Laid-Open Patent Publication No. 58-172660/1983, discloses a developing device, as one type, in which a toner storing section (room) is provided in the developing device, and toner is stored in each of toner storing sections (toner storing rooms or units) divided by radial partition members.

Japanese Laid-Open Utility Model Publication No. 52-135146/1977, discloses another type of developing device which supplements toner, in the timing when lack of toner supplement arises, from a toner cartridge which is installed in the developing device.

For the purpose of down-sizing of a developing device, a developing device which is provided with a relatively large capacity toner storing member located outside of the developing device has been developed. For example, Japanese Patent Publication No. 60-8330/1989, discloses a developing device in which a developing unit is separately provided from a developing device.

Japanese Open-Laid Patent Publication No. 62-251772/1987, discloses a developing device in which a toner storing section, which corresponds to a plurality of developing devices, is provided in a same axle as a rotary central journal of a rotary type developing device, and toner is supplemented from the storing section to each of the developing devices by a conveyor member such as a screw-like conveyor member.

However, the disclosed structures in Japanese Laid-Open Patent Publication No. 58-172660/1981 can not supplement toner from outside of the developing device when toner is finished in the device and so it is necessary that a whole device is replaced by a new whole device. But the replacement of the whole device is not economical.

Furthermore, in the disclosed structures in Japanese Laid-Open Patent Publication No. 52-43441/1977 or Japanese Laid-Open Publication Utility Model No. 52-135146/1977, it is necessary to undesirably scale up the capacity of the toner cartridge for the purpose of reducing the frequency that toner cartridge must be exchanged. As a result, the developing device becomes a large one and the freedom of the device layout is relatively restricted.

In the developing device disclosed in Japanese Patent Publication No. 60-8330/1989, the toner supplement mechanism is very complex, and in the developing device disclosed in Japanese Open-Laid Patent Publication No. 62-251772/1987, it is necessary to provide a device for monitoring the remaining toner in each of the developing device, a detecting element for detecting the remaining toner and a control device for supplying toner.

SUMMARY OF THE INVENTION

Accordingly, one object of the present invention to provide a novel and improved image forming apparatus having a revolver type developing device or an improved rotary type developing device, in which the above-mentioned conventional shortcomings are eliminated.

More specifically, it is an object of the present invention to provide an image forming apparatus having a revolver type developing device or a rotary type developing device which supplies a required amount of toner to a toner supply roller and a developing roller at all times, which provides an image forming apparatus with a great freedom of layout, and which needs a minimum of sectional space relative to a photoconductive element and which, therefore, has a miniature configuration.

It is another object of the present invention to provide an improved image forming apparatus having a revolver type developing device or an improved rotary type developing device which only if the amounts of transport of first and second conveyor members are adequately selected, the device insures a uniform developer (toner) distribution in the longitudinal direction thereof without resorting to a complicated control.

BRIEF DESCRIPTION OF THE DRAWINGS

A more complete appreciation of the present invention and many of the attendant advantages thereof will by readily obtained as the same becomes better understood by reference to the following detailed description of the invention when considered in conjunction with the accompanying drawings, wherein:

FIG. 4(*b*) is a sectional side elevation view of the developing unit for the rotary type developing device according to the present invention;

FIG. 5(*b*) is a sectional front view of the developing unit for the rotary type developing device according to the alternative embodiment of the present invention; and FIG. 5(*c*) is a sectional side elevation view of the developing unit for the rotary type developing device according to the alternative embodiment of the present invention.

DETAILED DESCRIPTION OF THE PREFERRED EMBODIMENTS

Figure 1:
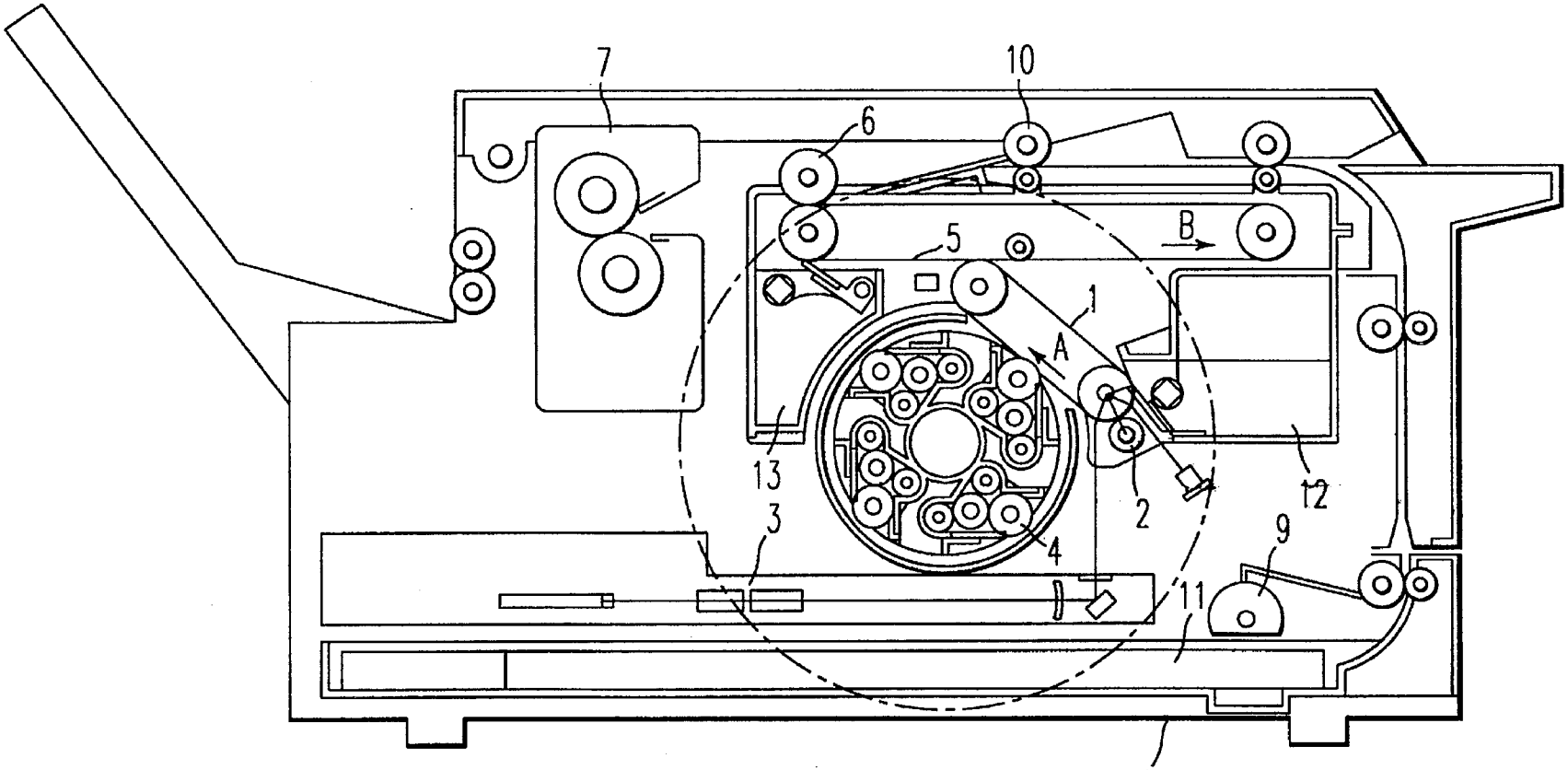
FIG. 1 is a schematic front view showing an embodiment of a printer as an image forming apparatus according to the present invention.

Referring now to the Figures, wherein like reference numerals designate identical or corresponding parts throughout the several views, and more particularly to FIG. 1, there is shown a schematic front view showing an embodiment of a printer as an image forming apparatus according to the present invention.

In FIG. 1, a printer has a belt-like photosensitive member 1 as an electrostatical latent image carrier. The photosensitive member 1 rotates in the direction as shown in FIG. 1 by an arrow A and is substantially uniformly charged to sensitize its surface by a charging roller 2 as charge means for electrostatically charging the photosensitive member 1. The resulting electrostatic latent images based on image information is focused onto the photosensitive member 1 by laser optical device 3 for electrostatically scanning the belt-like photosensitive member 1 which is exposed to color-dissolved light images. As a result, latent images are formed on the belt-like photosensitive member 1 which has been uniformly charged by the charging roller 2. Herein, the light image is color-dissolved and latent images each corresponding to image information of each dissolved-color is projected onto the belt-like photosensitive member 1 being focused on the exposure position.

Figure 2:
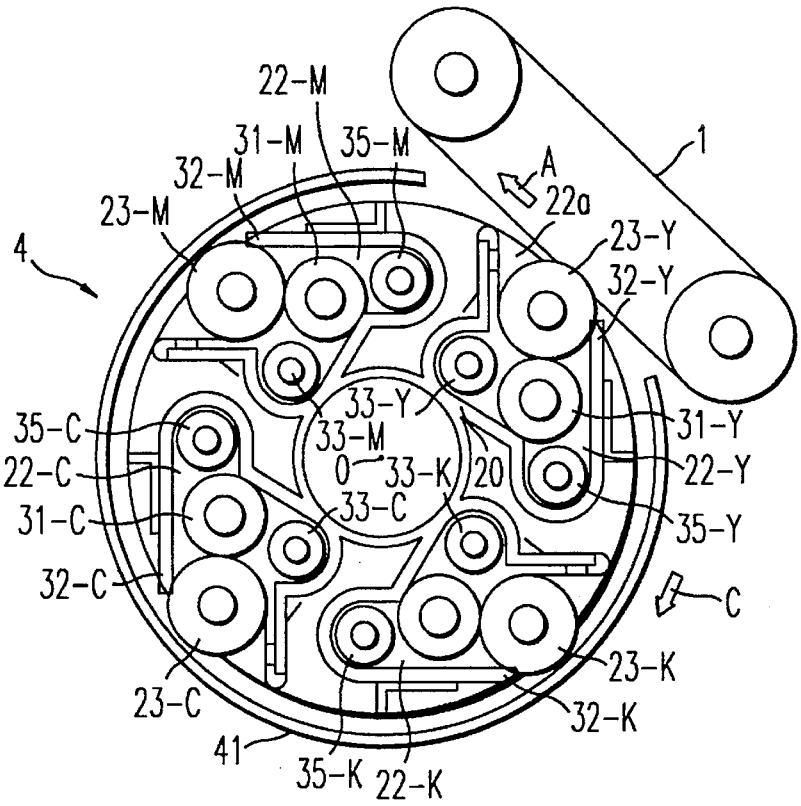
FIG. 2 is a sectional view of the rotary or revolver type developing device according to the present invention.

Latent images each being formed by laser rays generated from the laser optical device 3 are developed by yellow, magenta, cyan and black developing units, respectively 31-Y, 31-M, 31-C and 31-K, accommodated in a rotary type of developing device or a revolver 4, see also FIG. 2. Each toner image of four colors, yellow, magenta, cyan and black, are sequentially formed on the belt-like photosensitive member 1 and each color toner image of the four colors is sequentially transferred from the belt-like photosensitive member 1 to a middle transfer belt 5. As a result, full color images are formed on the middle transfer belt 5.

In an image transfer section, the middle transfer belt 5 is passed over the belt-like photosensitive member 1. A sheet 11 is fed from a tray 8 toward a register roller 10 by a pick-up roller 9 and then to the transfer belt 5. As the transfer belt 5 is moved in the direction as shown by arrow B in FIG. 1 while carrying the sheet 11 thereon, a full color image is transferred from the middle transfer belt 5 to the sheet 11 by a transfer roller 6 at a stroke. As a result, a full color image is formed on the sheet 11.

Thereafter, the sheet 11 is discharged together with the transfer belt 5 by a discharger (not shown) and is thereby separated from the transfer belt 5. Finally, the image on the sheet 11 is fixed by a fixing device 7 to produce a full color image.

A reference will now be made to FIGS. 2 and 3 for describing the construction and operation of a rotary or revolver type developing device 4 in detail. FIG. 2 is a sectional view of the rotary or revolver type developing device, and FIG. 3 is a perspective view of the rotary or revolver type developing device.

As shown in FIG. 2, the developing device 4 is disposed to be adjacent to the belt-like photosensitive member 1. The rotary type developing device (revolver) 4 has a hollow cylindrical casing 20 rotatable around a shaft having a central portion for rotation. The casing 20 is rotated in a direction C by a drive transmission mechanism which will be described. Four partitions 21, which divide the casing 20 to make four developing units, extend radially outward from the shift to form the previously mentioned developing units 22-Y, 22-M, 22-C and 22-K.

Figure 3:
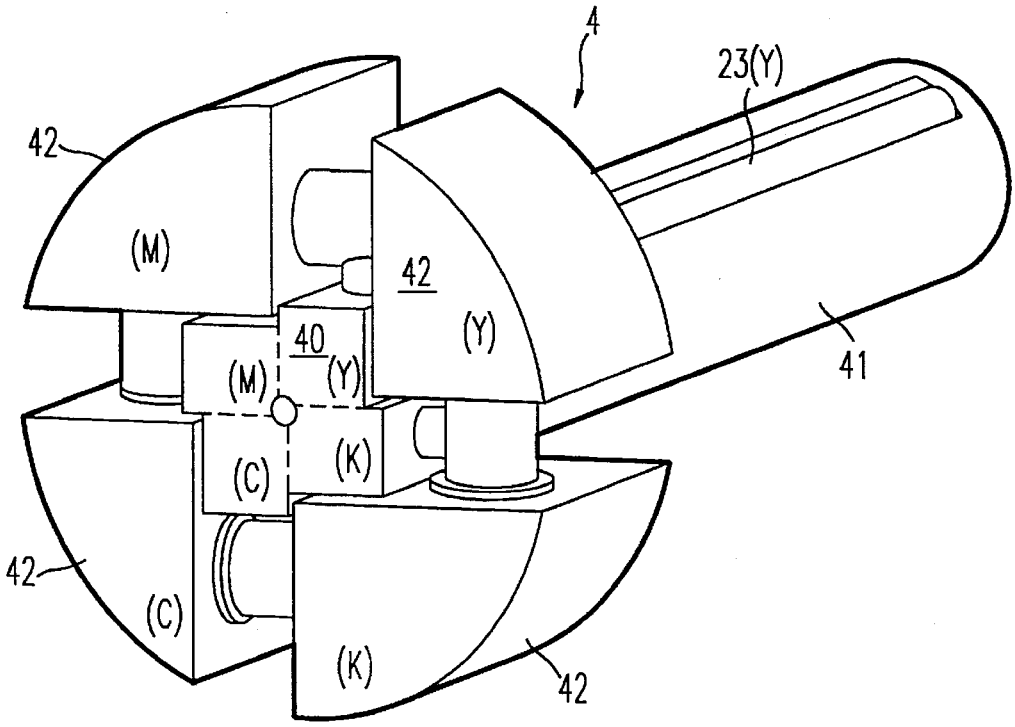
FIG. 3 is a perspective view of the rotary or revolver type developing device according to the present invention.

In the arrangement shown in FIGS. 2 and 3, the developing unit 22-Y is shown as being located at a developing position. The developing units 22-Y, 22-M, 22-Cc and 22-K accommodate respective developing rollers, or developer carriers 23-Y, 23-M, 23-C and 23-K therein. The developing rollers 23-Y, 23-M, 23-C and 23-K are each partly exposed to the outside via respective openings formed through the casing 20. A drive transmission mechanism causes the developing rollers 23-Y, 23-M, 23-C and 23-K to rotate in a counterclockwise direction as viewed in FIG. 2.

In the illustrative embodiments, the developing units 22-Y, 22-M, 22-C and 22-K respectively store yellow, magenta, cyan and black toners, i.e., non-magnetic one component developers. The developing units 22-Y, 22-M, 22-C and 22-K are selectively rotated to synchronize with color information around the shaft to the developing position to sequentially develop latent usages formed on the belt-like photosensitive member 1. Each of the developed images are transferred to the middle transfer belt 5 and color toner images are sequentially formed one above the other on the middle transfer belt 5, and thus the full color toner images are formed on the middle transfer belt 5. Furthermore, full color images are then formed on the sheet 11.

Each of the developing rollers 23-Y, 23-M, 23-C and 23-K is pressed against each of the respective developer supply rollers 31-Y, 31-M, 31-C and 31-K and made of foamed polyurethane or a similar elastic material. The developing roller 23 is rotated in a counterclockwise direction as viewed in FIG. 2 by the drive transmission mechanism to supply the toner to the associated one of the developing rollers 23 while charging it by friction. A respective blade 32 is located downstream of each of the developing rollers 23 with respect to the direction of counterclockwise as viewed in FIG. 2 and is located in the nearby opening 22*a*. The blade 32 is also made of polyurethane rubber, or a similar elastic material. One end of the blade 32 is pressed against the associated developing roller 23 to regulate the thickness of a toner layer formed on the roller 23.

The revolver 4 is rotatably disposed in a hollow cylindrical cover 41 together with the shaft. The cover or protector 41 has an opening at the top thereof and is formed with an opening which faces the belt-like photosensitive member 1 at the developing position. The cover or protector 41 can be formed integrally by plastic molding.

Hereinafter, embodiments of each developing unit 22Y, 22-M, 22-C and 22-K for the rotary type developing device concerning this invention will be described based on FIGS. 4(*a*) and 4(*b*).

In this embodiment, the constituents which are the same as or similar as to those of the previous embodiments are designated by the same reference numerals, and a detailed description thereof will not be made to avoid redundancy.

The developing device 4 deposits a non-magnetic one-component carrier, i.e., a toner, on a latent image electrostatically formed on the belt photosensitive member 1.

A developer carrier in the form of the developing roller 23(-Y) is disposed in the cover 41 to face the belt-like photosensitive member 1 via the opening of the cover 41 and the developing unit 22 (-Y :Yellow) is located below the belt-like photosensitive member 1. In the developing position, the opening 22*a* is formed in an upper portion of the developing unit 22. In the opening position, the developing roller 23 (-Y) as developer carrier faces toward the belt-like photosensitive member 1. The developing roller 23 is rotated at a predetermined peripheral speed ratio to the belt-like photosensitive member 1 and in a direction identical with the direction as observed at the position where the developing roller 23 contacts the belt-like photosensitive member 1.

A toner supply roller 31 is positioned below the developing roller 23 and is made of foam polyurethane or a similar elastic material. The supply roller 31 slidingly contacts the developing roller 23 at a predetermined peripheral speed ratio.

At a position "a" where the supply roller 31 contacts the developing roller 23, the former is rotated in the same direction as the latter. At this position a, a toner is transferred from the supply roller 31 to the developing roller 23.

A blade 32 made of urethane rubber or a similar elastic material is located at a position downstream of the position with respect to the direction of the developing roller movement and is adjoining the opening of cover 41. The blade 32 is held in contact with the periphery of the developing roller 23 at one end thereof.

Figure 4A:
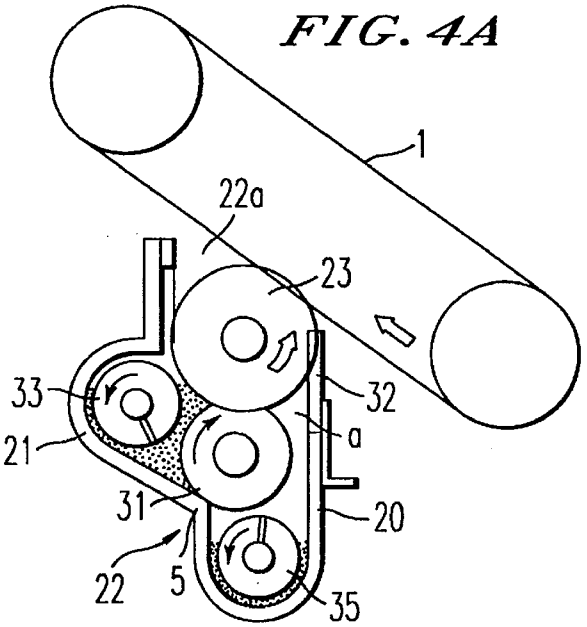
FIG. 4(*a*) is a sectional front view of a developing unit for the rotary type developing device according to the present invention.
Figure 4B:
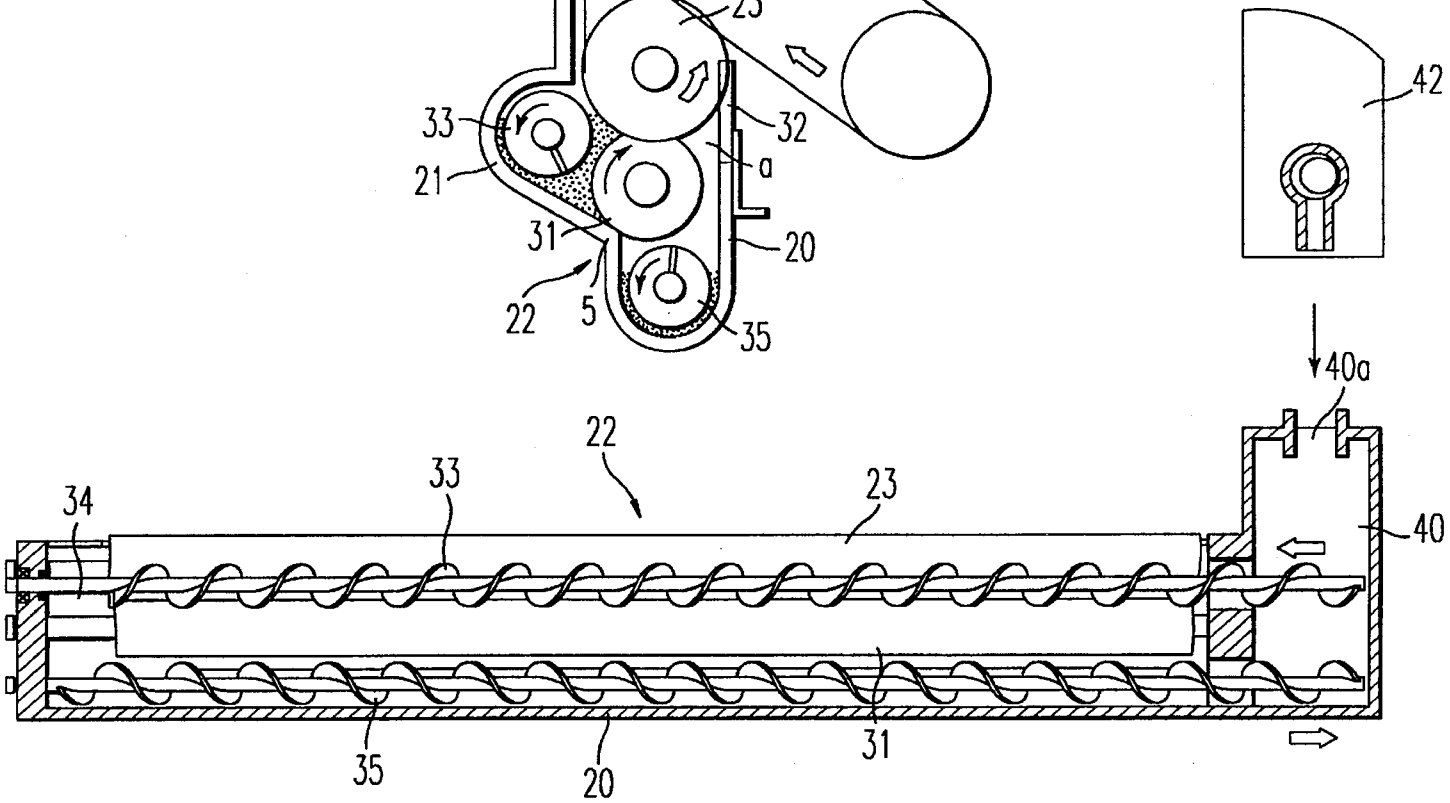

A first screw-like conveyor member 33 is also disposed in the casing 20 and conveys the toner from the viewer's side to the opposite side in the direction perpendicular to the sheet surface, see FIG. 4(*a*).

As shown in FIG. 4(*b*), the toner storing section or hopper (toner storing sector) 40 is provided on the view's side of the developing device 4, i.e., on the front side of the image forming apparatus.

A first conveyor member 33 extends from the hopper 40 in the direction perpendicular to the sheet surface of FIG. 4 (*a*) in parallel with the developing roller 23 and supply roller 31.

A drive mechanism (not shown) controllably drives the first conveyor member 33 in a direction for conveying toner independently of the developing roller 23 and supply roller 31.

A seal portion "S" in partition portion 21 is accommodated in the casing 20 and is implemented as an elastic sheet. Part of the seal portion "S" is held in contact with the periphery of the supply roller 31. In this configuration, the developing roller 23, supply roller 31, seal portion "S", and casing 20 form a toner transport space.

The first conveyor member 33 is disposed in the toner transport space and conveys the toner out of the hopper 40 toward the upstream side of the previously mentioned position with respect to the direction in which the supply roller 31 rotates.

In operation, the toner in the transport space is transferred from the supply roller 31 to the developing roller 23 at the position "a" while being charged by friction. The toner deposited on the developing roller 23 is leveled by the blade 32 to form a thin toner layer having a predetermined thickness. The developing roller 23 carrying such a toner layer develops an electrostatic latent image formed on the surface of the belt-like photosensitive member 1 by contact developing or non-contact developing.

FIG. 4(*b*) shows the developing unit in a perspective view. As shown, the hopper 40 has an opening 40*a* at the top thereof. A toner cartridge 42 has an opening which is provided with a projection connecting with the toner cartridge 42. The toner cartridge 42 comprises a connector supporting portion which supports a connecting member. The connecting member has a first connecting section, in which the first connecting section is rotatably supported on the projection, and a second section is divided from the first connect section and is connected with an engagement section in the top of toner cartridge 42.

After the toner cartridge 42 has been mounted on the hopper 40 with an opening aligned with the opening 40*a* of the hopper 40, the toner cartridge 42 is rotated to feed a toner to the hopper 40 by 180 degrees.

Also, the toner cartridge 42 can be detachable from the top of the hopper 40, and the toner cartridge 42 is exchanged when the end signal of the toner is detected by the sensor (not shown) in the adjacent portion to the cartridge 42. Thereafter, the toner hopper 40 is filled by new toner from a new toner cartridge 42. In this embodiment, the developing device 4 has four toner cartridges 42.

The toner not contributed to the development is conveyed by the first conveyor member 33 to the other side of the casing 20 opposite to the hopper 40.

A communication passage or toner circulation passage 34 is defined at the outside of the effective diameter portions of the rollers 23 and 31. The toner transported by the first conveyor member 33 to the toner circulation passage 34 is dropped to the bottom of the casing 20 by gravity.

A second screw-like conveyor member 35 is located in close proximity to the bottom of the casing 20 and extends in parallel to the rollers 23 and 31 and the first conveyor member 33. The second conveyor member 35 is rotated in such a manner as to convey the toner in the opposite direction to the first conveyor member 33, and thereby returns the excessive part of the toner not used by the development to the hopper 40.

Only if the amounts of toner to be transported by the two conveyor members 33 and 35 are adequately selected, there can be implemented a developing device 4 capable of feeding the toner to the supply roller 31 without resorting to a complicated control, promoting the free layout of the equipment, and occupying a minimum of a sectional area.

Figure 5B:
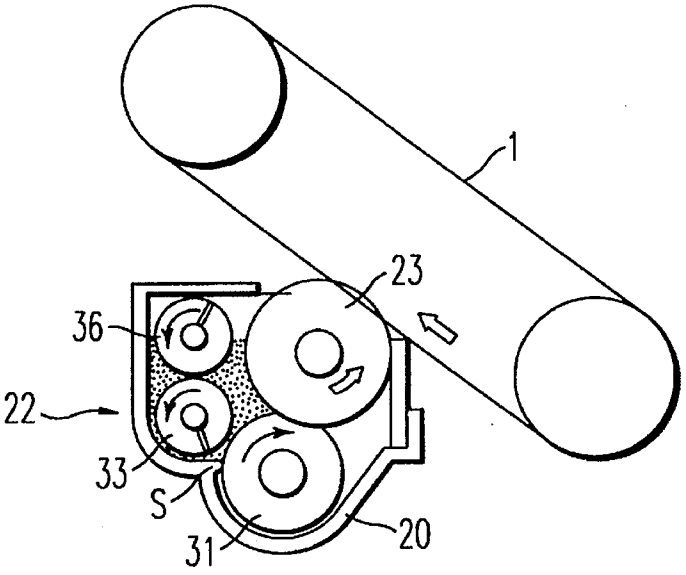
FIG. 5(*a*) is a sectional front view of the developing unit for the rotary type developing device according to an alternative embodiment of the present invention.
Figure 5A:
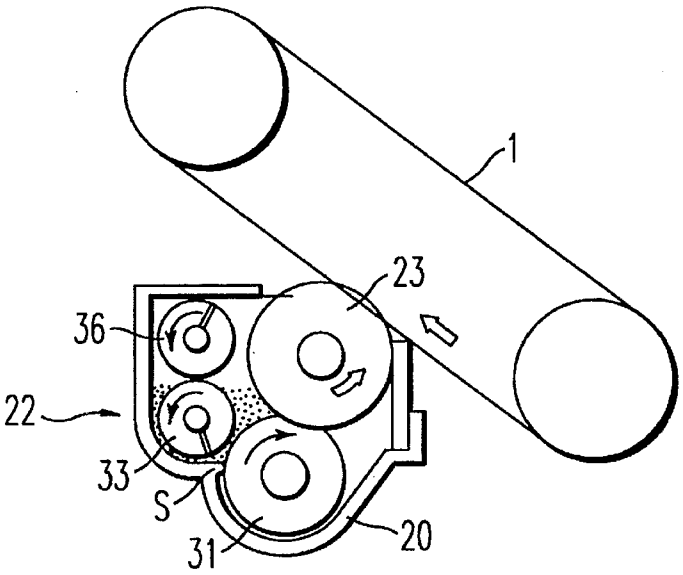
Figure 5C:
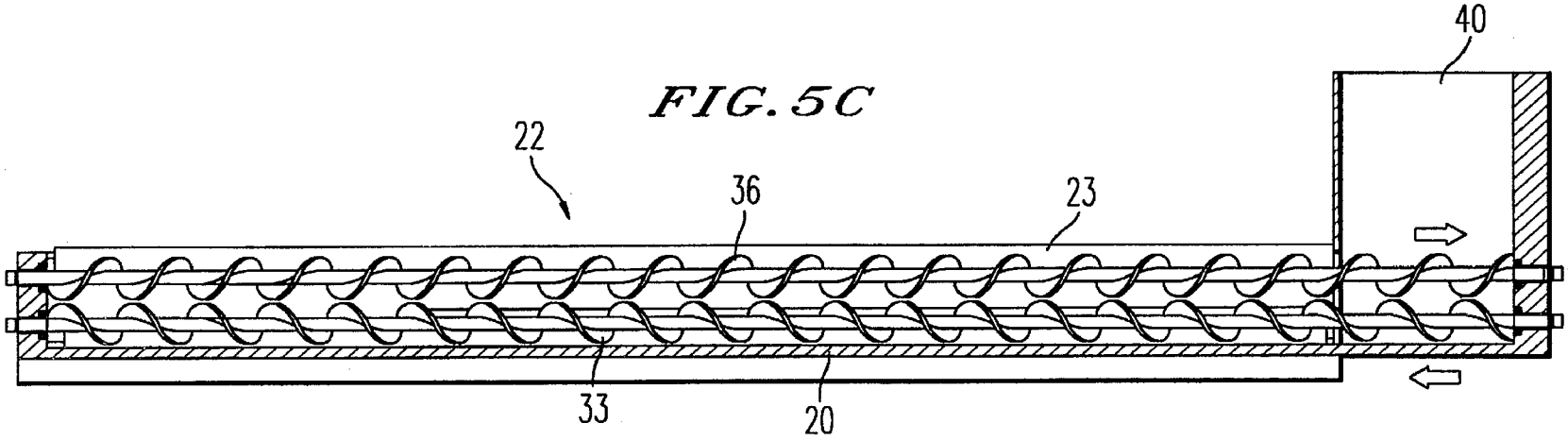

Referring to FIGS. 5(*a*), 5(*b*) and 5(*c*), alternative embodiments of the present invention will be described. In this embodiment, the constituents which are the same as or similar to those of the previous embodiment are designated by the same reference numerals, and a detailed description thereof will not be made to avoid redundancy. As shown, a first screw-like conveyor member 33 in disposed in the casing to take the role of the conveyor member. The elastic supply roller 31 is held in contact with both of the developing roller 23 and the casing 20. The developing roller 23, the supply roller 31 and casing 20 form a toner transport space surrounding the first conveyor member 33. A seal portion (rib) "S" extends from part of the inner periphery of the casing and contacts the supply roller.

In the illustrative embodiment, the first conveyor member 33 is rotated in association with and at predetermined peripheral speed ratios to the developing roller 23 and the supply roller 31. The first conveyor member 33, therefore, conveys the toner from the hopper 40 into the toner transport space so as to feed it to the supply roller 31.

The supply roller 31 supplies the toner to the surface of the developing roller 23 while frictionally charging it in cooperation with the roller 23. The toner deposited on the developing roller 23 is leveled by the blade 32 to form a toner layer having a predetermined thickness. The developing roller 23 carrying such a toner layer develops a latent image formed on the belt-like photosensitive member 1.

The second conveyor member 36 is disposed above the first conveyor member 33 to extend in parallel therewith to the developing roller 23, the supply roller 31, and the first conveyor member 33. The second conveyor member 36 is rotated in the opposite direction to the first conveyor member 33, as in the previous embodiment.

Generally, a greater amount of toner than the maximum amount of toner to be consumed by development should constantly exist in the toner transport space surrounding the first conveyor member 33.

However, the problem is that the amount of toner consumption depends on the total area of an image to be developed and the image arrangement in the width-wise direction. The toner in the transport space is conveyed to and accumulated at the side opposite to the hopper 40 of the developing device 4. Further, the distribution of the toner in the width-wise direction of the transport space is not uniform since the amount of toner consumption in the width-wise direction of the device 4 depends on the image size (paper size), image layout, image area, etc.

In this embodiment, the second conveyor member 36 is disposed above the first conveyor member 33 and is rotated in the opposite direction to the member. As shown in FIG. 5(*a*), so long as the level of the toner existing in the transport space is lower than the level where the first conveyor member 33 is positioned, the toner is transported by the first conveyor roller 33 away from the hopper 40 to the other side of the developing device 4.

As shown in the FIG. 5(*b*), as the level of the toner in the toner transport space reaches the transport level of the second conveyor member 36, i.e., the amount of toner becomes excessive, the excessive part of the toner is transported toward the hopper 40, i.e., toward the viewer's side by the conveyor member 36. The second conveyer member 36, therefore, supplements the positions where the toner is short while returning the excessive toner to the hopper 40. As a result, the amount of toner in the transport space is maintained constant, and the toner distribution in the width-wide direction is also maintained substantially constant.

In summary, it will be seen that the present invention provides a developing device having various unprecedented advantages, as enumerated below.

(1) The device supplies a required amount of toner to a toner supply roller and a developing roller at all times, provides an image forming apparatus with a great freedom of layout, and needs a minimum of sectional space relative to a photoconductive element and, therefore, has a miniature configuration.

(2) Only if the amounts of transport of first and second conveyor members are adequately selected, the device insures a uniform developer (toner) distribution in the longitudinal direction thereof without resorting to a complicated control.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to secured by Letter Patent of the United States is:

1. An image forming apparatus comprising:

an image carrier; and a revolver developing device rotatable around a shaft to bring any one of a plurality of developing units to face said image carrier for effecting development at a developing position;

each of said developing units comprising:

a casing rotatably accommodating said developing device therein;

a toner storing section provided on one side of said casing;

a first conveyor member for conveying toner from the toner storing section to a developing area a second conveyor member for conveying used toner from the developing area to the toner storing section; and a toner cartridge mounted on said toner storing section for feeding new toner to the toner storing section.

2. The image forming apparatus as claimed in claim 1, further comprising:

a protective member having an opening which faces said image carrier at the developing position when said protective member is mounted on said image forming apparatus.

3. The image forming apparatus as claimed in claim 1, wherein a number of said plural developing units is four.

4. The image forming apparatus as claimed in claim 1, wherein said image carrier is a belt-like photosensitive member.

5. The image forming apparatus as claimed in claim 1, wherein said toner cartridge can be detachable from said toner storing section.

6. An image forming apparatus, comprising:

an image carrier; and a revolver developing device rotatable around a shaft to bring any one of a plurality of developing units to face said image carrier for effecting development at a developing position;

each of said developing units comprising:

a casing rotatably accommodating said developing device therein;

a toner storing section provided on one side of said casing;

a first conveyor member for conveying toner from the toner storing section to a developing area;

a second conveyor member for conveying used toner from the developing area to the toner storing section;

a toner cartridge mounted on said toner storing section for feeding new toner to the toner storing section; and wherein said first conveyor member conveys toner from said toner storing section to a toner supply roller, which comes into contact with a developing roller, and wherein said first conveying member is disposed in said casing.

7. The image forming apparatus as claimed in claim 6, wherein said toner supply roller and said developing roller are paralleled with said first conveyor member.

8. The image forming apparatus as claimed in claim 6, wherein said first conveyor member conveys toner toward an upstream side of a position where said supply roller comes into contact with the developing roller, with respect to a direction in which the supply roller rotates.

9. The image forming apparatus as claimed in claim 8, wherein said first conveyor member is disposed in a toner transport space of said casing; and the second conveyor member is disposed in a bottom of said casing.

10. An image forming apparatus comprising:

an image carrier; and a revolver developing device rotatable around a shaft to bring any one of a plurality of developing units to face said image carrier for effecting development at a developing position;

each of said developing units comprising:

a casing rotatably accommodating said developing device therein;

a toner storing section provided on one side of said casing;

a first conveyor member for conveying toner from said toner storing section-to a toner transport space in which a toner supply roller, which comes into contact with a developing roller, is disposed in said casing;

a second conveyor member for conveying used toner from a communication passage to said toner storing section, wherein said second conveyor member is disposed in said casing; and a toner cartridge mounted on said toner storing section for feeding new toner to the toner storing section.

11. An image forming apparatus as claimed in claim 10, further comprising:

a protective member having an opening which faces said image carrier at the developing position when said protective member is mounted on said image forming apparatus.

12. The image forming apparatus an claimed in claim 10, wherein said image carrier is a belt-like photosensitive member.

13. The image forming apparatus as claimed in claim 10, wherein said toner cartridge can be detachable from said toner storing section.

14. An image forming apparatus, comprising:

an image carrier; and a revolver developing device rotatable around a shaft to bring any one of a plurality of developing units to face said image carrier for effecting development at a developing position;

each of said developing units comprising:

a casing rotatably accommodating said developing device therein;

a toner storing section provided on one side of said casing;

a first conveyor member for conveying toner from said toner storing section to a toner transport space in which a toner supply roller, which comes into contact with a developing roller, is disposed in said casing;

a second conveyor member for conveying used toner from a communication passage to said toner storing section, wherein said second conveyor member is disposed in said casing; and a toner cartridge mounted on said toner storing section for feeding new toner to the toner storing section;

wherein said first conveyor member conveying toner is rotated in a predetermined direction in which toner is conveyed from said toner storing section to said toner transport space; and wherein said second conveyor member for returning toner from said toner transport space to said toner storing section is disposed in a bottom of said casing and below said first conveyor member.

15. An image forming apparatus, comprising:

an image carrier; and a revolver developing device rotatable around a shaft to bring any one of a plurality of developing units to face said image carrier for effecting development at a developing position;

each of said developing units comprising:

a casing rotatably accommodating said developing device therein;

a toner storing section provided on one side of said casing;

a first conveyor member for conveying toner from said toner storing section to a toner transport space in which a toner supply roller, which comes into contact with a developing roller, is disposed in said casing;

a second conveyor member for conveying used toner from a communication passage to said toner storing section, wherein said second conveyor member is disposed in said casing; and a toner cartridge mounted on said toner storing section for feeding new toner to the toner storing section;

wherein said first conveyor member conveying toner is rotated in a predetermined direction in which toner is conveyed from said toner storing section to said toner transport space; and wherein said second conveyor member for conveying toner, in which said second conveyor member is rotated in an opposite direction to the first conveyor member, is disposed in a bottom of the casing; and wherein said toner supply roller and the developing roller are paralleled with the first and second conveyor members.

16. An image forming apparatus comprising:

an image carrier; and a revolver developing device rotatable around a shaft to bring any one of a plurality of developing units to face said image carrier for effecting development at a developing position;

each of said developing units comprising:

a casing rotatably accommodating said developing device therein and including a toner transport space;

a toner storing section provided on one side of said casing;

a first conveyor member for conveying toner from said toner storing section to the toner transport space, in which a toner supply roller, which comes into contact with said developing roller, is disposed in said casing;

a second conveyor member for conveying toner which is disposed above said supply roller in said toner transport space of the casing and returns non-contributed toner for development from said transport space to said toner storing section; and a toner cartridge mounted on said toner storing section for feeding new toner to the toner storing section.

17. The image forming apparatus as claimed in claim 16, further comprising:

a protective member having an opening which faces said image carrier at the developing position when said protective member is mounted on said apparatus.

18. The image forming apparatus as claimed in claim 16, wherein said first conveyor member for conveying toner is rotated in a predetermined direction in which toner is conveyed from said toner storing section to said toner transport space; and said second conveyor member for conveying toner is rotated in an opposite direction to the first conveyor member.

19. The image forming apparatus as claimed in claim 16, wherein a number of said plural developing units is four.

20. The image forming apparatus as claimed in claim 16, wherein said first conveyor member for conveying toner is rotated in a predetermined direction in which toner is conveyed from said toner storing section to said toner transport space; and said second conveyor member for conveying toner is rotated in an opposite direction to the first conveyor member; and said toner supply roller and the developing roller are paralleled with the first and second conveyor members.

21. The image forming apparatus as claimed in claim 16, wherein said image carrier is a belt-like photosensitive member.

22. The image forming apparatus as claimed in claim 16, wherein said first conveyor member conveys toner toward an upstream side of a position where said supply roller contacts said developing roller, with respect to a direction in which the supply roller rotates.

23. The image forming apparatus as claimed in claim 16, wherein said toner cartridge can be detachable from said toner storing section.

* * * * *